US010036986B2

(12) United States Patent
Shimada et al.

(10) Patent No.: US 10,036,986 B2
(45) Date of Patent: Jul. 31, 2018

(54) FIXING DEVICE AND IMAGE FORMING APPARATUS

(71) Applicants: Hiroyuki Shimada, Tokyo (JP); Takashi Fujita, Kanagawa (JP)

(72) Inventors: Hiroyuki Shimada, Tokyo (JP); Takashi Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/289,439

(22) Filed: Oct. 10, 2016

(65) Prior Publication Data

US 2017/0123357 A1 May 4, 2017

(30) Foreign Application Priority Data

Oct. 28, 2015 (JP) ..... 2015-211529

(51) Int. Cl.
*G03G 15/20* (2006.01)

(52) U.S. Cl.
CPC ..... *G03G 15/2075* (2013.01); *G03G 15/2053* (2013.01); *G03G 15/2064* (2013.01)

(58) Field of Classification Search
CPC ..... G03G 15/2053; G03G 15/2064; G03G 15/2075
See application file for complete search history.

(56) References Cited

U.S. PATENT DOCUMENTS

| | | | | |
|---|---|---|---|---|
| 6,559,421 | B1 | 5/2003 | Yura et al. | |
| 2002/0113050 | A1* | 8/2002 | Yura | G03G 15/2053 219/216 |
| 2003/0192869 | A1 | 10/2003 | Yura et al. | |
| 2015/0125193 | A1* | 5/2015 | Ishii | G03G 15/2042 399/329 |

FOREIGN PATENT DOCUMENTS

| | | |
|---|---|---|
| JP | 2002-139939 | 5/2002 |
| JP | 2002-311751 | 10/2002 |
| JP | 2004-170692 | 6/2004 |
| JP | 2010-217205 | 9/2010 |
| JP | 2015-111243 | 6/2015 |

* cited by examiner

*Primary Examiner* — Hoang Ngo
(74) *Attorney, Agent, or Firm* — Oblon, McClelland, Maier & Neustadt, L.L.P.

(57) ABSTRACT

A fixing device includes a fixing belt being endless and rotatable in a predetermined direction of rotation. The fixing belt includes an inner circumferential face applied with a fluorine compound. A nip formation pad is not rotatable. The inner circumferential face of the fixing belt slides over the nip formation pad. A pressure rotator presses against the nip formation pad via the fixing belt to form a fixing nip between the fixing belt and the pressure rotator. At least one heater heats the fixing belt. The heater includes a glass tube filled with an inert gas containing, as a main ingredient, a substance having a first molecular weight greater than a second molecular weight of argon.

11 Claims, 5 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2015-211529, filed on Oct. 28, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween, through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing belt being endless and rotatable in a predetermined direction of rotation. The fixing belt includes an inner circumferential face applied with a fluorine compound. A nip formation pad is not rotatable. The inner circumferential face of the fixing belt slides over the nip formation pad. A pressure rotator presses against the nip formation pad via the fixing belt to form a fixing nip between the fixing belt and the pressure rotator. At least one heater heats the fixing belt. The heater includes a glass tube filled with an inert gas containing, as a main ingredient, a substance having a first molecular weight greater than a second molecular weight of argon.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing belt being endless and rotatable in a predetermined direction of rotation. The fixing belt includes an inner circumferential face applied with a fluorine compound. A nip formation pad is not rotatable. The inner circumferential face of the fixing belt slides over the nip formation pad. A pressure rotator presses against the nip formation pad via the fixing belt to form a fixing nip between the fixing belt and the pressure rotator. At least one heater heats the fixing belt. The heater includes a glass tube filled with an inert gas containing, as a main ingredient, a substance having a first molecular weight greater than a second molecular weight of argon.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
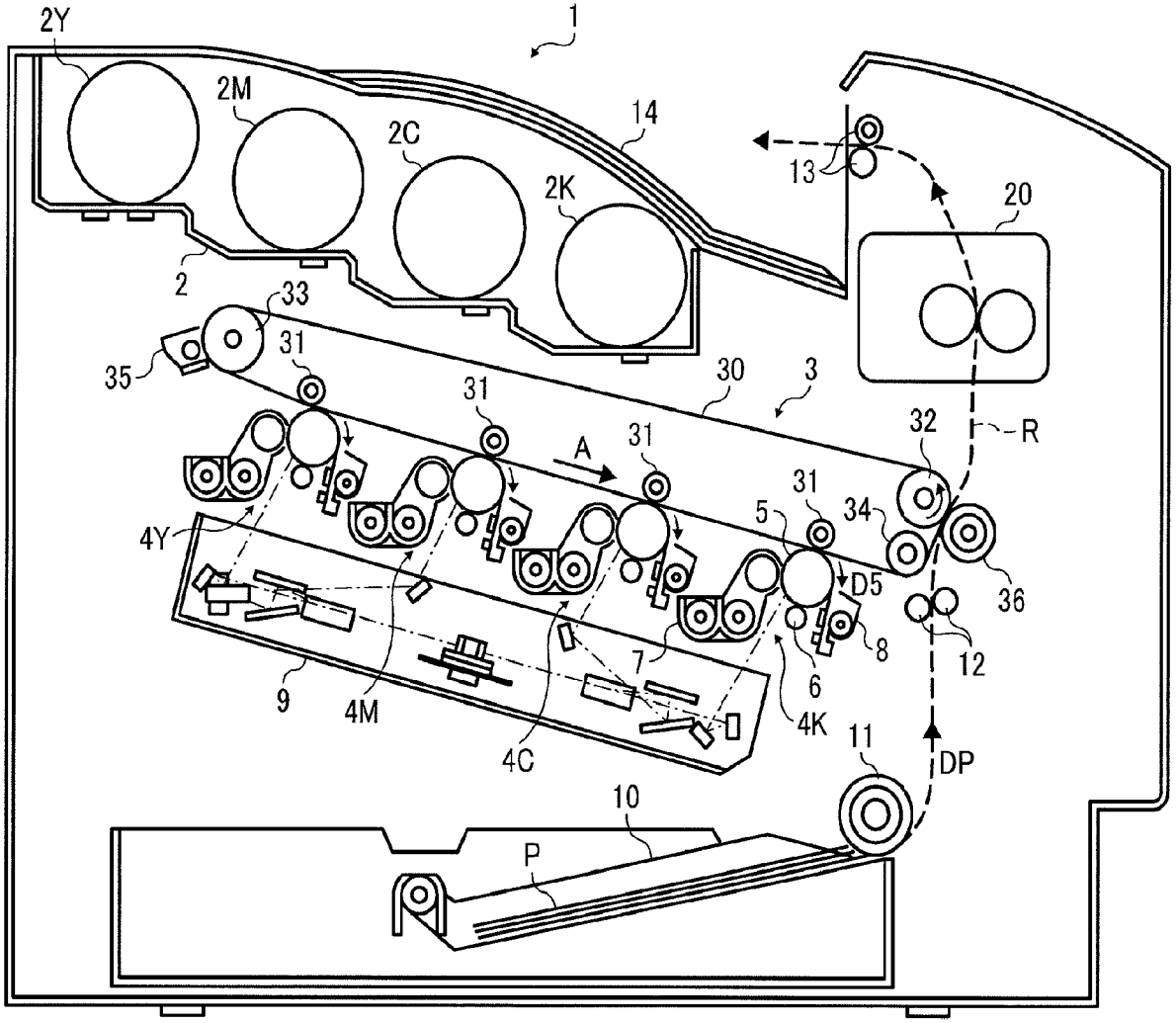
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

As illustrated in FIG. 1, the image forming apparatus 1 includes four image forming devices 4Y, 4M, 4C, and 4K situated in a center portion thereof. Although the image forming devices 4Y, 4M, 4C, and 4K contain developers in different colors, that is, yellow, magenta, cyan, and black corresponding to color separation components of a color image (e.g., yellow, magenta, cyan, and black toners), respectively, the image forming devices 4Y, 4M, 4C, and 4K have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5.

FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-O lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as a transferor, four primary transfer rollers 31 serving as primary transferors, and a secondary transfer roller 36 serving as a secondary transferor. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction A by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply that applies at least one of a predetermined direct current (DC) voltage and a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies at least one of a predetermined direct current (DC) voltage and a predetermined alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a conveyor conveys the sheet P conveyed from the feed roller 11 toward the secondary transfer nip.

The conveyance path R is further provided with a fixing device 20 located above the secondary transfer nip, that is, downstream from the secondary transfer nip in the sheet conveyance direction DP. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constructing color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction A by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 conveys the sheet P sent to the conveyance path R by the feed roller 11 to the secondary transfer nip formed between the secondary transfer roller 36 and the intermediate transfer belt at a proper time. The secondary transfer roller 36 is applied with a transfer voltage having a polarity opposite a polarity of the charged yellow, magenta, cyan, and black toners constructing the full color toner image formed on the intermediate transfer belt 30, thus creating a transfer electric field at the secondary transfer nip.

As the yellow, magenta, cyan, and black toner images constructing the full color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor toner image or a tricolor toner image by using two or three of the image forming devices 4Y, 4M, 4C, and 4K.

Figure 2:
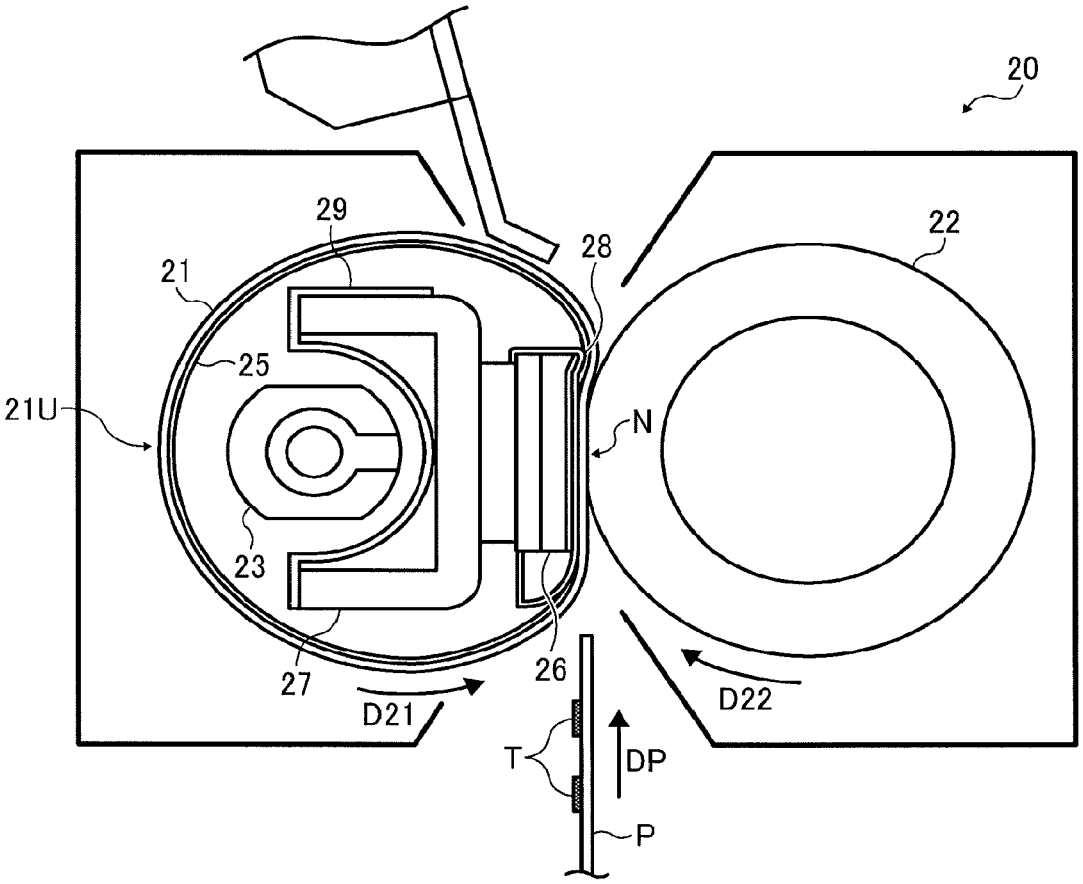
FIG. 2 is a vertical cross-sectional view of a fixing device according to a first exemplary embodiment of the present disclosure that is incorporated in the image forming apparatus depicted in FIG. 1.
Figure 3:
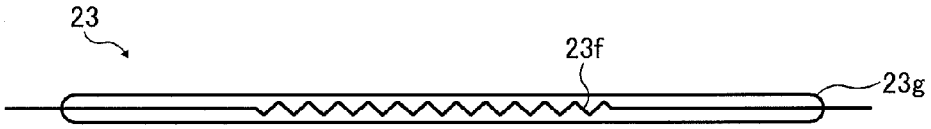
FIG. 3 is a cross-sectional view of a halogen heater incorporated in the fixing device depicted in FIG. 2.

Referring to FIGS. 2 and 3, a description is provided of a construction of the fixing device 20 according to a first exemplary embodiment that is incorporated in the image forming apparatus 1 having the construction described above.

FIG. 2 is a vertical cross-sectional view of the fixing device 20. As illustrated in FIG. 2, the fixing device 20 (e.g., a fuser or a fusing unit) includes a fixing belt 21 formed into a loop, a halogen heater 23, a nip formation pad 26, a stay 27, and a reflector 29 that are disposed inside the loop formed by the fixing belt 21 and a pressure roller 22 disposed outside the loop formed by the fixing belt 21. The fixing belt 21 includes an inner circumferential face 25. The fixing belt 21 and the components disposed inside the fixing belt 21, that is, the halogen heater 23, the nip formation pad 26, the stay 27, and the reflector 29, may construct a belt unit 21U separably coupled to the pressure roller 22.

The fixing belt 21 serves as a fixing rotator or a fixing member rotatable in a rotation direction D21. The pressure roller 22 serves as a pressure rotator rotatable in a rotation direction D22. The halogen heater 23 serving as a heater or a heat source is disposed inside the loop formed by the fixing belt 21. The halogen heater 23 emits heat or light that irradiates the inner circumferential face 25 of the fixing belt 21 directly, heating the fixing belt 21 with radiant heat or light.

FIG. 3 is a cross-sectional view of the halogen heater 23. As illustrated in FIG. 3, the halogen heater 23 is a halogen lamp including a glass tube 23*g* filled with an inert gas containing xenon or krypton as a main ingredient. A molecular weight of each of xenon and krypton is greater than a molecular weight of argon.

As illustrated in FIG. 2, the nip formation pad 26 is disposed inside the loop formed by the fixing belt 21 and disposed opposite the pressure roller 22 via the fixing belt 21. The nip formation pad 26 presses against the pressure roller 22 via the fixing belt 21 to form a fixing nip N between the fixing belt 21 and the pressure roller 22. As a sheet P serving as a recording medium bearing a toner image T is conveyed through the fixing nip N, the fixing belt 21 heated by the halogen heater 23 and the pressure roller 22 fix the toner image T on the sheet P under heat and pressure. As the fixing belt 21 rotates in the rotation direction D21, the inner circumferential face 25 of the fixing belt 21 slides over the nip formation pad 26 directly or indirectly via a slide sheet interposed between the fixing belt 21 and the nip formation pad 26. The inner circumferential face 25 of the fixing belt 21 is applied with a lubricant such as fluorine oil and fluorine grease to reduce friction between the nip formation pad 26 and the fixing belt 21. The lubricant is fluorine grease or silicone grease containing fluorine particles as a thickener. The inner circumferential face 25 of the fixing belt 21, which slides over the nip formation pad 26, may be applied with a fluorine compound such that the fluorine compound forms an inner circumferential layer of the fixing belt 21.

As illustrated in FIG. 2, the fixing nip N is planar. Alternatively, the fixing nip N may be contoured into a recess, a curve, or other shapes. If the fixing nip N is recessed with respect to the pressure roller 22, the recessed fixing nip N directs a leading edge of the sheet P toward the pressure roller 22 as the sheet P is discharged from the fixing nip N, facilitating separation of the sheet P from the fixing belt 21 and suppressing jamming of the sheet P.

A detailed description is now given of a construction of the fixing belt 21.

The fixing belt 21 is an endless belt or film made of metal such as nickel and SUS stainless steel or resin such as polyimide. The fixing belt 21 is constructed of a base layer and a release layer. The release layer serving as an outer surface layer is made of tetrafluoroethylene-perfluoroalkylvinylether copolymer (PFA), polytetrafluoroethylene (PTFE), or the like to facilitate separation of toner of the toner image T on the sheet P from the fixing belt 21 and prevent the toner from adhering to the fixing belt 21. An elastic layer may be sandwiched between the base layer and the release layer and made of silicone rubber or the like. If the fixing belt 21 does not incorporate the elastic layer, the fixing belt 21 has a decreased thermal capacity that improves fixing property of being heated quickly to a predetermined fixing temperature at which the toner image T is fixed on the sheet P. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T that may appear as a faulty orange peel image on the sheet P. To address this circumstance, the elastic layer made of silicone rubber has a thickness not smaller than 100 micrometers. As the elastic layer deforms, the elastic layer absorbs slight surface asperities of the fixing belt 21, preventing formation of the faulty orange peel image.

A detailed description is now given of a configuration of the stay 27 and the reflector 29.

The stay 27 serving as a support that supports the nip formation pad 26 is situated inside the loop formed by the fixing belt 21. As the nip formation pad 26 receives pressure from the pressure roller 22, the stay 27 supports the nip formation pad 26 to prevent bending of the nip formation pad 26 and produce an even nip length in the sheet conveyance direction DP throughout the entire width of the fixing belt 21 in an axial direction thereof parallel to a longitudinal direction of the nip formation pad 26. The stay 27 is made of metal to attain rigidity. The stay 27 is mounted on and secured to side plates at both lateral ends of the stay 27 in a longitudinal direction thereof parallel to the axial direction of the fixing belt 21, respectively, thus being positioned inside the fixing device 20.

Since the nip formation pad 26 has a complex shape, the nip formation pad 26 is made of heat resistant resin and manufactured by injection molding. For example, the heat resistant resin may be liquid crystal polymer (LCP) having a heat resistant temperature of about 330 degrees centigrade, polyetherketone (PEK) having a heat resistant temperature of about 350 degrees centigrade, or the like.

The reflector 29 interposed between the halogen heater 23 and the stay 27 reflects light or heat radiated from the halogen heater 23 to the reflector 29 toward the fixing belt 21, preventing the stay 27 from being heated by the halogen heater 23 and thereby reducing waste of energy. Alternatively, instead of the reflector 29, an opposed face of the stay 27 disposed opposite the halogen heater 23 may be treated with insulation or mirror finish to reflect light or heat radiated from the halogen heater 23 to the stay 27 toward the fixing belt 21.

A detailed description is now given of a construction of the pressure roller 22.

The pressure roller 22 is constructed of a cored bar, an elastic rubber layer coating the cored bar, and a surface release layer coating the elastic rubber layer and made of PFA or PTFE to facilitate separation of the sheet P from the pressure roller 22. As a driving force generated by a driver (e.g., a motor) situated inside the image forming apparatus 1 depicted in FIG. 1 is transmitted to the pressure roller 22 through a gear train, the pressure roller 22 rotates clockwise in FIG. 2 in the rotation direction D22. Alternatively, the driver may also be coupled to the fixing belt 21 to drive and rotate the fixing belt 21. A spring or the like presses the pressure roller 22 against the nip formation pad 26 via the fixing belt 21. As the spring presses and deforms the elastic rubber layer of the pressure roller 22, the pressure roller 22 produces the fixing nip N having the predetermined length in the sheet conveyance direction DP.

The pressure roller 22 may be a hollow roller or a solid roller. If the pressure roller 22 is a hollow roller, a heater such as a halogen heater may be disposed inside the hollow roller. The elastic rubber layer may be made of solid rubber. Alternatively, if no heater is situated inside the pressure roller 22, the elastic rubber layer may be made of sponge rubber. The sponge rubber is more preferable than the solid rubber because the sponge rubber has an enhanced insulation that decreases an amount of heat drawn from the fixing belt 21.

As the pressure roller 22 rotates in the rotation direction D22, the fixing belt 21 rotates counterclockwise in FIG. 2 in the rotation direction D21 in accordance with rotation of the pressure roller 22 by friction therebetween. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. At the fixing nip N, the fixing belt 21 rotates as the fixing belt 21 is sandwiched between the pressure roller 22 and the nip formation pad 26; at a circumferential span of the fixing belt 21 other than the fixing nip N, the fixing belt 21 rotates while the fixing belt 21 is guided by a flange at each lateral end of the fixing belt 21 in the axial direction thereof. As the sheet P is conveyed through the fixing nip N, the fixing belt 21 and the pressure roller 22 apply heat and pressure to the sheet P, fixing the toner image T on the sheet P. With the construction described above, the fixing device 20 attaining quick warm-up is manufactured at reduced costs.

A bulge 28 projects from a downstream end of the nip formation pad 26 in the sheet conveyance direction DP, that is, an exit of the fixing nip N, toward the pressure roller 22. The bulge 28 does not press against the pressure roller 22 via the fixing belt 21 and therefore is not produced by contact with the pressure roller 22. The bulge 28 lifts the sheet P conveyed through the exit of the fixing nip N from the fixing belt 21, facilitating separation of the sheet P from the fixing belt 21.

A description is provided of a construction of a comparative fixing device.

The comparative fixing device includes a rotatable, endless fixing belt, a stationary nip formation pad, and a pressure roller pressed against the nip formation pad via the fixing belt to form a fixing nip between the fixing belt and the pressure roller. As the fixing belt rotates, an inner circumferential surface of the fixing belt slides over the nip formation pad frictionally. The nip formation pad has a slide face over which the fixing belt slides. The slide face is coated with a fluorine compound to reduce friction between the nip formation pad and the fixing belt. A halogen heater is disposed opposite the inner circumferential surface of the fixing belt. The halogen heater includes a glass tube filled with argon as an inert gas.

A controller may suffer from malfunction and may fail to control power supply to the halogen heater, causing the halogen heater to overheat the fixing belt. To address this failure, a safety device such as a thermal fuse and a thermo switch incorporated in an energizing circuit of the halogen heater mechanically blocks power supply to the halogen heater compulsorily, thus preventing overheating of the comparative fixing device. However, since the comparative fixing device is configured to heat the fixing belt to a predetermined temperature quickly, a surface temperature of the glass tube of the halogen heater may increase to a temperature of 400 degrees centigrade or higher instantaneously before the safety device blocks power supply to the halogen heater compulsorily. As the fixing belt slides over the nip formation pad, the fixing belt scrapes the fluorine compound off the nip formation pad. The scraped fluorine compound adheres to a surface of the glass tube of the halogen heater. When the halogen heater heats the fluorine compound adhered to the surface of the glass tube to the temperature of 400 degrees centigrade or higher, the fluorine compound starts decomposing to generate a fluorine gas. The fluorine gas may react with moisture in an atmosphere, generating noxious hydrofluoric acid.

To address this circumstance of the comparative fixing device, the fixing device 20 depicted in FIG. 2 has a configuration described below.

Figure 4:
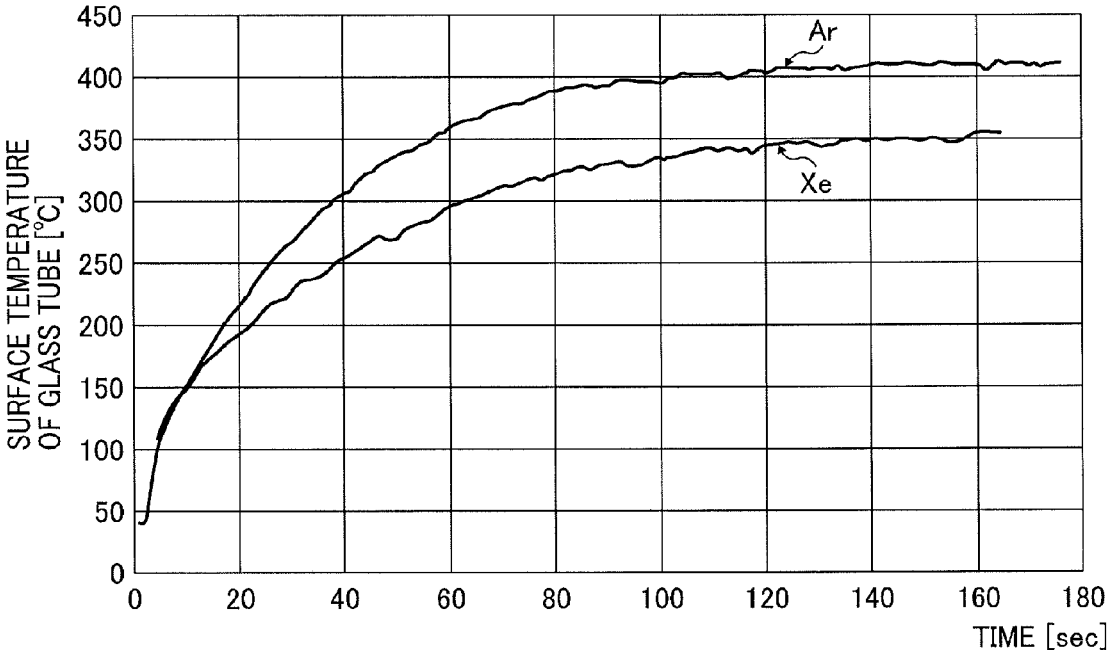
FIG. 4 is a graph illustrating temperature increase of a glass tube of the halogen heater depicted in FIG. 3.

FIG. 4 is a graph illustrating a result of an experiment, that is, temperature increase of a surface of the glass tube 23*g* of the halogen heater 23 that is filled with a xenon gas instead of an argon gas as an inert gas. FIG. 4 illustrates a curve Ar attained with a glass tube filled with the argon gas and a curve Xe attained with the glass tube 23*g* filled with the xenon gas.

The result of the experiment indicates that the temperature of the glass tube filled with the argon gas exceeds 400 degrees centigrade when 110 seconds elapse after a fixing operation starts. Conversely, even when 110 seconds elapse after the fixing operation starts, the temperature of the glass tube 23*g* filled with the xenon gas is retained at about 350 degrees centigrade that is lower than 400 degrees centigrade at which hydrofluoric acid generates. Under a heat generation mechanism of the halogen heater 23, as the inert gas fills a space inside the glass tube 23*g*, pressure of the inert gas suppresses evaporation of tungsten used in a filament 23*f* depicted in FIG. 3. The evaporated tungsten collides with molecules of the inert gas and does not propagate rectilinearly, increasing vapor pressure of peripheral tungsten. Accordingly, evaporation of the tungsten is suppressed, resulting in the extended life of the halogen heater 23.

Such advantage of the inert gas enhances as the molecular weight increases. As the molecular weight of the inert gas increases, convection decreases to draw a decreased amount of heat from the filament 23*f*. Accordingly, a decreased amount of heat is conducted from the filament 23*f* to the glass tube 23*g* through the inert gas, suppressing temperature increase of the glass tube 23*g*.

The inert gas used in the halogen heater 23 includes helium, neon, argon, krypton, xenon, and radon which are enumerated according to the molecular weight. For example, helium has a smallest molecular weight. Radon has a greatest molecular weight. Accordingly, krypton and xenon are advantageous over argon. Xenon is advantageous over krypton.

The glass tube 23*g* of the halogen heater 23 is filled with the inert gas having a molecular weight greater than the molecular weight of argon to suppress temperature increase of the glass tube 23*g*. Even if the controller fails to control the halogen heater 23 properly and the halogen heater 23 suffers from overheating, the inert gas filling the glass tube 23*g* suppresses generation of hydrofluoric acid. Radon is unpractical and avoided because radon is a radioactive gas having a short half-life.

Figure 5:
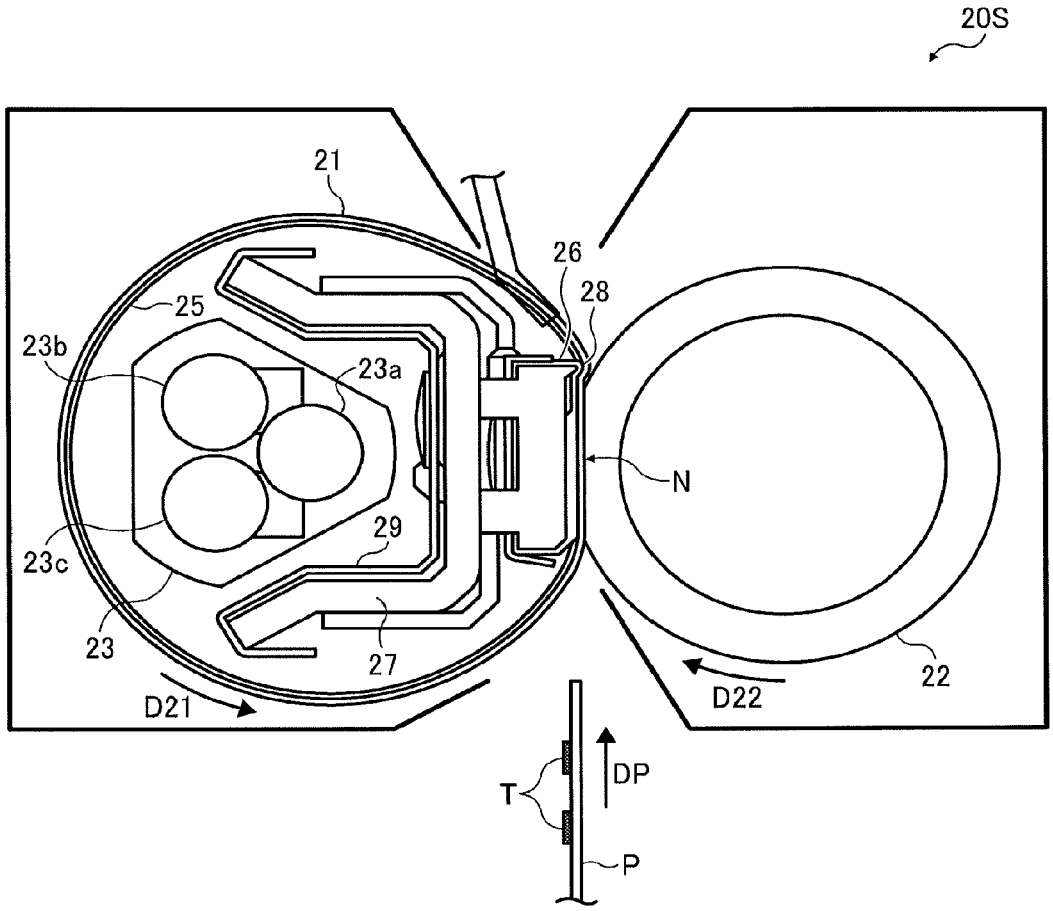
FIG. 5 is a vertical cross-sectional view of a fixing device according to a second exemplary embodiment of the present disclosure that is installable in the image forming apparatus depicted in FIG. 1.

Referring to FIG. 5, a description is provided of a construction of a fixing device 20S according to a second exemplary embodiment.

FIG. 5 is a vertical cross-sectional view of the fixing device 20S. Unlike the fixing device 20 depicted in FIG. 2 that includes the single halogen heater 23, the fixing device 20S depicted in FIG. 5 includes three halogen heaters 23*a*, 23*b*, and 23*c* that serve as a heater for heating the fixing belt 21. Other components of the fixing device 20S are substantially equivalent to the components of the fixing device 20. Hence, identical reference numerals are assigned to the components of the fixing device 20S that are equivalent to the components of the fixing device 20 and redundant description is omitted.

With the increased number of the halogen heaters 23*a*, 23*b*, and 23*c*, the fixing device 20S performs fixing on sheets P of various sizes while maintaining productivity. The halogen heaters 23*a*, 23*b*, and 23*c* are filled with an inert gas containing xenon or krypton as a main ingredient. The bulge 28 projects from the downstream end of the nip formation pad 26 that is in proximity to the exit of the fixing nip N toward the pressure roller 22. The bulge 28 does not press against the pressure roller 22 via the fixing belt 21 and therefore is not produced by contact with the pressure roller 22. The bulge 28 facilitates separation of a sheet P from the fixing belt 21.

Figure 6:
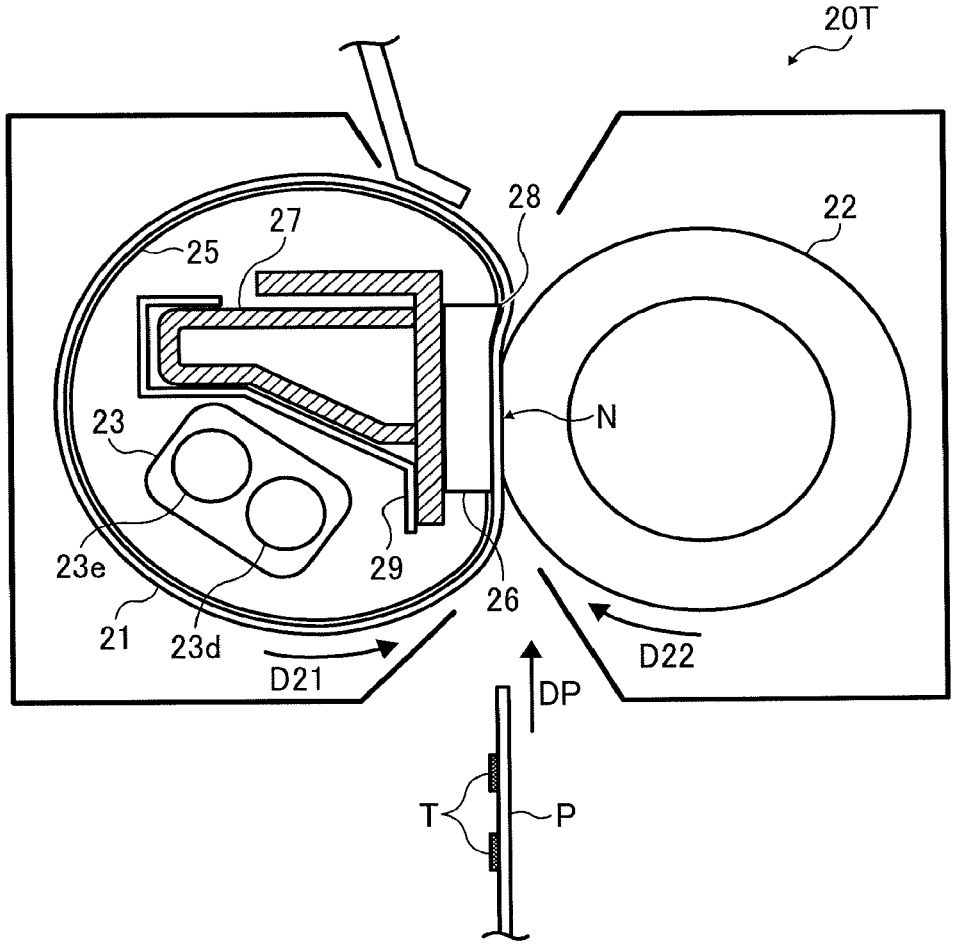
FIG. 6 is a vertical cross-sectional view of a fixing device according to a third exemplary embodiment of the present disclosure that is installable in the image forming apparatus depicted in FIG. 1.

Referring to FIG. 6, a description is provided of a construction of a fixing device 20T according to a third exemplary embodiment.

FIG. 6 is a vertical cross-sectional view of the fixing device 20T. Unlike the fixing device 20 depicted in FIG. 2 that includes the single halogen heater 23, the fixing device 20T depicted in FIG. 6 includes two halogen heaters 23*d* and 23*e* that serve as a heater for heating the fixing belt 21. The halogen heaters 23*d* and 23*e* are filled with an inert gas containing xenon or krypton as a main ingredient. The bulge 28 projects from the downstream end of the nip formation pad 26 that is in proximity to the exit of the fixing nip N toward the pressure roller 22. The bulge 28 does not press against the pressure roller 22 via the fixing belt 21 and therefore is not produced by contact with the pressure roller 22. The bulge 28 facilitates separation of a sheet P from the fixing belt 21.

When a plurality of small sheets P having a width smaller than a heat generation span of the halogen heater 23 depicted in FIG. 2 is conveyed over the fixing belt 21 continuously, a non-conveyance span of the fixing belt 21, outboard from a conveyance span in the axial direction of the fixing belt 21, where the small sheets P are not conveyed may overheat substantially to a temperature above a heat resistant temperature of the fixing belt 21 because the small sheets P do not draw heat from the non-conveyance span of the fixing belt 21. For example, in the image forming apparatus 1 capable of high speed printing, the sheet P is conveyed at a conveyance speed higher than a thermal conduction speed at which heat is conducted in the nip formation pad 26 in the longitudinal direction thereof. Accordingly, an amount of heat input to the fixing belt 21 and an amount of heat output from the fixing belt 21 increase per unit time, resulting in substantial overheating of each lateral end of the fixing belt 21 in the axial direction thereof.

Similarly, the stay 27 situated inside the loop formed by the fixing belt 21 is susceptible to heat from the halogen heater 23 for an extended period of time.

To address those circumstances, the fixing device 20S depicted in FIG. 5 includes the three halogen heaters 23*a*, 23*b*, and 23*c* that have different heat generation spans corresponding to various widths of sheets P, respectively, in the axial direction in the fixing belt 21. The fixing device 20T depicted in FIG. 6 includes the two halogen heaters 23*d* and 23*e* that have different heat generation spans corresponding to various widths of sheets P, respectively, in the axial direction in the fixing belt 21.

The exemplary embodiments described above are one example and attain advantages below in a plurality of aspects A to F.

A description is provided of advantages of the fixing devices 20, 20S, and 20T in an aspect A.

As illustrated in FIGS. 2, 5, and 6, a fixing device (e.g., the fixing devices 20, 20S, and 20T) includes an endless fixing belt (e.g., the fixing belt 21), a heater (e.g., the halogen heaters 23, 23*a*, 23*b*, 23*c*, 23*d*, and 23*e*), a pressure rotator (e.g., the pressure roller 22), and a nip formation pad (e.g., the nip formation pad 26). The fixing belt is rotatable in a predetermined direction of rotation (e.g., the rotation direction D21). The fixing belt includes an inner circumferential face (e.g., the inner circumferential face 25) applied with or containing a fluorine compound. The heater heats the fixing belt. The nip formation pad is not rotatable. The inner circumferential face of the fixing belt slides over the nip formation pad. The pressure rotator is pressed against the nip formation pad via the fixing belt to form a fixing nip (e.g., the fixing nip N) between the fixing belt and the pressure rotator. As the fixing belt rotates, the inner circumferential face of the fixing belt slides over the nip formation pad.

As illustrated in FIG. 3, the heater includes a glass tube (e.g., the glass tube 23*g*) filled with an inert gas containing, as a main ingredient, a substance having a first molecular weight greater than a second molecular weight of argon. The glass tube of the heater is filled with a halogen gas as the inert gas. The heater further includes a filament (e.g., the filament 23*f*) disposed inside the glass tube.

As a predetermined electric current flows in the filament made of tungsten, the tungsten generates heat and emits light. The tungsten evaporates and bonds with the halogen gas to form a tungsten halide. Convection generated inside the glass tube brings the tungsten halide into contact with the glass tube, causing the tungsten halide to heat the glass tube. Thereafter, the tungsten halide moves to a proximity to the filament again. The tungsten halide separates into a halogen atom and a tungsten atom. The tungsten atom returns to the filament. The tungsten atom bonds with and separates from the floating halogen atom repeatedly.

In the aspect A, the inert gas filling the glass tube of the heater is a gas containing a substance as a main ingredient that has the first molecular weight greater than the second molecular weight of argon, such as xenon and krypton. Accordingly, the glass tube in the aspect A generates the convection less than the glass tube filled with argon, reducing conduction of heat to the glass tube. Consequently, the glass tube is immune from temperature increase and therefore has a temperature lower than a decomposition temperature of 400 degrees centigrade, for example, of the fluorine compound. Even if a controller fails to control power supply to the heater, the temperature of the glass tube does not reach the decomposition temperature of the fluorine compound or higher. Accordingly, even if the fluorine compound adheres to a surface of the glass tube of the heater, the fluorine compound adhered to the glass tube does not generate hydrofluoric acid.

A description is provided of advantages of the fixing devices 20, 20S, and 20T in an aspect B.

In the aspect A, the inert gas contains xenon or krypton as the main ingredient. The inert gas filling the glass tube of the heater contains xenon or krypton having the first molecular weight greater than the second molecular weight of argon. Accordingly, the glass tube in the aspect B reduces the convection of the tungsten halide inside the glass tube, reducing conduction of heat to the glass tube. Consequently, the temperature of the glass tube does not increase, preventing the fluorine compound adhered to the glass tube from generating hydrofluoric acid.

A description is provided of advantages of the fixing devices 20, 20S, and 20T in an aspect C.

In the aspect A or B, the fluorine compound is a lubricant interposed between the nip formation pad and the inner circumferential face of the fixing belt. The lubricant is fluorine oil or fluorine grease. Accordingly, the glass tube in the aspect C reduces the convection of the tungsten halide inside the glass tube, reducing conduction of heat to the glass tube. Consequently, the temperature of the glass tube does not increase, preventing the fluorine oil or the fluorine grease adhered to the glass tube from generating hydrofluoric acid.

A description is provided of advantages of the fixing devices 20, 20S, and 20T in an aspect D.

In the aspect C, the lubricant is fluorine grease or silicone grease containing fluorine particles as a thickener. Accordingly, the glass tube in the aspect D reduces the convection of the tungsten halide inside the glass tube, reducing conduction of heat to the glass tube. Consequently, the temperature of the glass tube does not increase, preventing the fluorine grease or the silicone grease containing the fluorine particles as the thickener and being adhered to the glass tube from generating hydrofluoric acid.

A description is provided of advantages of the fixing devices 20, 20S, and 20T in an aspect E.

In the aspect A or B, the fluorine compound applied to the inner circumferential face of the fixing belt forms an inner circumferential layer of the fixing belt. Accordingly, the glass tube in the aspect E reduces the convection of the tungsten halide inside the glass tube, reducing conduction of heat to the glass tube. Consequently, temperature increase of the glass tube is suppressed. Even if the fluorine compound contained in the inner circumferential layer of the fixing belt generates abrasion powder while the fixing belt slides over the nip formation pad and the abrasion powder adheres to the glass tube, the abrasion powder does not generate hydrofluoric acid.

A description is provided of advantages of the fixing devices 20, 20S, and 20T in an aspect F.

As illustrated in FIG. 1, an image forming apparatus (e.g., the image forming apparatus 1) includes an image forming device (e.g., the image forming devices 4Y, 4M, 4C, and 4K) to form a toner image on an image bearer (e.g., the photoconductor 5); a transfer device (e.g., the transfer device 3) to transfer the toner image formed on the image bearer onto a recording medium (e.g., a sheet P); and a fixing device (e.g., the fixing devices 20, 20S, and 20T) in the aspect A, B, C, D, or E to fix the toner image on the recording medium. Accordingly, the image forming apparatus reduces generation of hydrofluoric acid and enhances safety of an environment where the image forming apparatus is located.

According to the exemplary embodiments described above, the fixing belt 21 serves as a fixing belt. Alternatively, a fixing film, a fixing sleeve, or the like may be used as a fixing belt. Further, the pressure roller 22 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and features of different illustrative exemplary embodiments may be combined with each other and substituted for each other within the scope of the present disclosure.

What is claimed is:

1. A fixing device, comprising:

a fixing belt being endless and rotatable in a predetermined direction of rotation, the fixing belt including an inner circumferential face applied with a fluorine compound:

a nip formation pad not rotatable, the nip formation pad over which the inner circumferential face of the fixing belt slides;

a pressure rotator to press against the nip formation pad via the fixing belt to form a fixing nip between the fixing belt and the pressure rotator; and at least one heater to heat the fixing belt, the heater including a glass tube filled with an inert gas comprising, as a main ingredient, a substance having a first molecular weight greater than a second molecular weight of argon, wherein the at least one heater is adapted to function such that a temperature of the surface of the glass tube does not exceed 400° C. after a period of 100 seconds has elapsed following the start of a fixing operation.

2. The fixing device according to claim 1, wherein the heater comprises includes a halogen heater.

3. The fixing device according to claim 1, wherein the substance comprises one of xenon and krypton.

4. The fixing device according to claim 1, wherein the fluorine compound is a lubricant interposed between the nip formation pad and the inner circumferential face of the fixing belt.

5. The fixing device according to claim 4, wherein the lubricant is one of a fluorine oil and a fluorine grease.

6. The fixing device according to claim 4, wherein the lubricant is one of a fluorine grease and a silicone grease comprising fluorine particles as a thickener.

7. The fixing device according to claim 1, wherein the fluorine compound applied to the inner circumferential face of the fixing belt forms an inner circumferential layer of the fixing belt.

8. The fixing device according to claim 1, wherein the at least one heater includes two halogen heaters.

9. The fixing device according to claim 1, wherein the at least one heater includes three halogen heaters.

10. The fixing device according to claim 1, wherein the pressure rotator includes a pressure roller.

11. An image forming apparatus, comprising:

an image forming device to form a toner image; and a fixing device disposed downstream from the image forming device in a recording medium conveyance direction to fix the toner image on a recording medium, wherein the fixing device comprises:

a fixing belt being endless and rotatable in a predetermined direction of rotation, the fixing belt including an inner circumferential face applied with a fluorine compound;

a nip formation pad not rotatable, the nip formation pad over which the inner circumferential face of the fixing belt slides;

a pressure rotator to press against the nip formation pad via the fixing belt to form a fixing nip between the fixing belt and the pressure rotator; and at least one heater to heat the fixing belt, the heater including a glass tube filled with an inert gas comprising, as a main ingredient, a substance having a first molecular weight greater than a second molecular weight of argon, and wherein the at least one heater is adapted to function such that a temperature of the surface of the glass tube does not exceed 400° C. after a period of 100 seconds has elapsed following the start of a fixing operation.

* * * * *